US006586026B1

(12) United States Patent
Ramesh et al.

(10) Patent No.: US 6,586,026 B1
(45) Date of Patent: Jul. 1, 2003

(54) PACKAGE WITH CONTOURED SEAL

(75) Inventors: Ram K. Ramesh, Greenville, SC (US); Terry L. Troutt, Moore, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/646,943

(22) PCT Filed: Mar. 18, 1999

(86) PCT No.: PCT/US99/05995

§ 371 (c)(1),
(2), (4) Date: Dec. 7, 2000

(87) PCT Pub. No.: WO99/59817

PCT Pub. Date: Nov. 25, 1999

(51) Int. Cl.[7] ..... B65D 65/04; B65D 85/00

(52) U.S. Cl. ..... 426/127; 426/129; 426/412; 426/415; 53/479; 53/480

(58) Field of Search ..... 426/129, 412, 426/127, 415; 428/34.9, 35.2; 383/119, 113; 206/497; 53/479, 480, 517

(56) References Cited

U.S. PATENT DOCUMENTS

| | | | | |
|---|---|---|---|---|
| 3,853,999 | A | 12/1974 | Kentor | 426/105 |
| 3,928,938 | A | 12/1975 | Burrell | 53/22 |
| 3,950,919 | A | 4/1976 | Perdue | 53/22 |
| 4,064,296 | A | 12/1977 | Bornstein et al. | 428/35 |
| 4,120,716 | A | 10/1978 | Bonet | 156/272 |
| 4,285,980 | A | 8/1981 | Lewis | 426/249 |
| 4,410,011 | A | 10/1983 | Andra et al. | 138/118.1 |
| 4,411,919 | A | 10/1983 | Thompson | 426/412 |
| 4,469,742 | A | 9/1984 | Oberle et al. | 428/215 |
| 4,672,793 | A | 6/1987 | Terlizzi, Jr. et al. | 428/35.1 |
| 4,879,430 | A | 11/1989 | Hoffman | 426/110 |
| 5,120,553 | A * | 6/1992 | Kupcikevicius | 426/129 |
| 5,576,037 | A | 11/1996 | Moore, Jr. et al. | 426/110 |
| 6,270,819 | B1 * | 8/2001 | Wiese | 383/119 |

FOREIGN PATENT DOCUMENTS

| | | |
|---|---|---|
| CA | 2022839 | 3/1991 |
| WO | 99/59817 | 11/1999 |
| WO | 00/58093 | 10/2000 |

* cited by examiner

*Primary Examiner*—Nina Bhat
(74) *Attorney, Agent, or Firm*—Daniel B. Ruble

(57) ABSTRACT

A packaged food article includes a meat product and a thermoplastic, heat shrinkable film. The film includes a meat-contact layer that contains a polymer which includes mer units derived from a $C_2$–$C_4$ α-olefin. The film is sealed so as to form a bag which encloses the meat product. At least one of the seals defines an arc which includes at least four segments. Each of the segments has a radius of curvature which differs from the radius of curvature of any adjoining segment. When the packaged food article is subjected to a temperature of from about 50° C. up to about the Vicat softening point of the polymer of the meat-contact layer, the packaged food article takes the general shape of a poultry breast.

25 Claims, 3 Drawing Sheets

PACKAGE WITH CONTOURED SEAL

This application is the National Stage (35 U.S.C. §371) of International Application No. PCT/US99/05995 filed Mar. 18, 1999, which claims the benefit of U.S. Provisional Application No. 60/080,098 filed Mar. 31, 1998.

BACKGROUND INFORMATION

1. Field of the Invention

The present invention relates to packaged food articles, specifically articles where a food product is cooked after being packaged.

2. Background of the Invention

Many food products are processed in thermoplastic film packages by subjecting the packaged product to elevated temperatures produced by, for example, immersion in hot water or exposure to steam. Such thermal processing often is referred to as cook-in, and films used in such processes are known as cook-in films.

A food product that is packaged and processed in this manner can be refrigerated, shipped, and stored until the food product is to be consumed or, for example, sliced and repackaged into smaller portions for retail display. Many sliced luncheon meats are processed in this fashion. Alternatively, the processed food can be removed immediately from the cook-in package for consumption or further processing (e.g., sliced and repackaged).

A cook-in film must be capable of withstanding exposure to rather severe temperature conditions for extended periods of time while not compromising its ability to contain the food product. Cook-in processes typically involve a long cook cycle. Submersion in hot (i.e., about 55° to 65° C.) water for up to about 4 hours is common; submersion in 70° to 100° C. water or exposure to steam for up to 12 hours is not uncommon, although most cook-in procedures normally do not involve temperatures in excess of about 90° C. During such extended periods of time at elevated temperatures, any seams in a package formed from a cook-in film preferably resist failure (i.e., pulling apart).

The cook-in film preferably possesses sufficient adherence to the food product to inhibit or prevent "cook-out" (sometimes referred to as "purge"), which is water and/or juices that collect between the surface of the contained food product and the food-contact surface of the packaging material during the cook-in process. Preventing cook-out can increase product yield, provide a better tasting product, improve shelf life and provide a more aesthetically appealing packaged product. Films that adhere well to the packaged food product help reduce cook-out.

Many cook-in films are corona treated to increase the surface energy of their food-contact layers. However, corona treatment can be inconsistent, can result in a film with inconsistent adhesion, can result in a film having a surface energy that decays over time, and can interfere with the sealability of a film.

Following the cook-in process, the film or package preferably conforms, if not completely then at least substantially, to the shape of the contained food product. Often, this is achieved by allowing the film to heat shrink under cook-in conditions so as to form a tightly fitting package. In other words, the cook-in film desirably possesses sufficient shrink energy such that the amount of thermal energy used to cook the food product also is adequate to shrink the packaging film snugly around the contained product. Alternatively, the cook-in film package can be caused to shrink around the contained food product prior to initiating the cook-in procedure by, for example, placing the package in a heated environment prior to cooking.

Some presently available cook-in films adhere well with the meat product and do a good job of reducing cook-out. Additionally, most such films are able to withstand extended time periods at the elevated temperatures described supra; accordingly such films are adequate for many cook-in applications. However, some cook-in applications impose even more stringent performance requirements. For example, some food products that are processed via cook-in procedures are oxygen sensitive. Cook-in films for these products need to include one or more oxygen barrier layers. Other cook-in applications require that the film or the package made therefrom be printable and be able to retain any image printed thereon.

An increasingly important requirement of cook-in films is that they provide an aesthetically pleasing packaged food product. For example, as mentioned previously, the cook-in film generally shrinks until it at least substantially conforms to the shape of the enclosed food product; however, unless the shape of that food product is itself aesthetically pleasing, the resulting packaged food article does not have an aesthetically pleasing shape.

Because pre-forming the food article prior to packaging is impractical (and often impossible), providing a cook-in film that can provide a resulting packaged food article with an aesthetically pleasing shape is highly desirable.

SUMMARY OF THE INVENTION

Briefly, the present invention provides a packaged food article which includes a meat product and a thermoplastic, heat shrinkable film. The film includes a meat-contact layer that contains a polymer which includes mer units derived from a $C_2$–$C_4$ α-olefin. The film is sealed so as to form a bag which encloses the meat product. At least one sealed edge of the bag defines an arc which includes at least four segments. Each of the segments has a radius of curvature which differs from the radius of curvature of any adjoining segment.

When the packaged food article is subjected to a temperature of from about 50° C. up to about the Vicat softening point of the meat-contact layer polymer that includes mer units derived from a $C_2$–$C_4$ α-olefin, preferably up to about 100° C., the packaged food article advantageously takes the general shape of, for example, a poultry breast. Because the arc of the bag edge includes at least four segments with varying radii of curvature, the general shape of the packaged food article is not essentially spherical. Rather, the packaged food article has a more irregular, yet generally rounded appearance such as is observed in actual poultry breasts.

To assist in understanding the more detailed description of the invention that follows, certain definitions are provided immediately below. These definitions apply hereinthroughout unless a contrary intention is explicitly indicated:

"polymer" means the polymerization product of one or more monomers and is inclusive of homopolymers as well as copolymers, terpolymers, tetrapolymers, etc., and blends and modifications of any of the foregoing;

"mer unit" means that portion of a polymer derived from a single reactant molecule; for example, a mer unit from ethylene has the general formula $—CH_2CH_2—$;

"homopolymer" means a polymer consisting essentially of a single type of repeating mer unit;

"copolymer" means a polymer that includes mer units derived from two reactants (normally monomers) and is inclusive of random, block, segmented, graft, etc., copolymers;

"interpolymer" means a polymer that includes mer units derived from at least two reactants (normally monomers) and is inclusive of copolymers, terpolymers, tetrapolymers, and the like;

"polyolefin" means a polymer in which some mer units are derived from an olefinic monomer which can be linear, branched, cyclic, aliphatic, aromatic, substituted, or unsubstituted (e.g., olefin homopolymers, interpolymers of two or more olefins, copolymers of an olefin and a non-olefinic comonomer such as a vinyl monomer, and the like);

"(meth)acrylic acid" means acrylic acid and/or methacrylic acid;

"(meth)acrylate" means acrylate and/or methacrylate;

"anhydride functionality" means an group containing an anhydride moiety, such as that derived from maleic acid, fumaric acid, etc., whether blended with one or more polymers, grafted onto a polymer, or polymerized with one or more monomers;

"oxygen permeance" (in the packaging industry, "permeance" often is referred to as "transmission rate") means the volume of oxygen ($O_2$) that passes through a given cross section of film (or layer of a film) at a particular temperature and relative humidity when measured according to a standard test such as, for example, ASTM D 1434 or D 3985;

"longitudinal direction" means that direction along the length of a film, i.e., in the direction of the film as it is formed during extrusion and/or coating;

"transverse direction" means that direction across the film and perpendicular to the machine direction;

"free shrink" means the percent dimensional change, as measured by ASTM D 2732, in a 10 cm×10 cm specimen of film when subjected to heat;

"shrink tension" means the force per average cross-sectional area developed in a film, in a specified direction and at a specified elevated temperature, as the film attempts to shrink at that temperature while being restrained (measured in accordance with ASTM D 2838);

as a verb, "laminate" means to affix or adhere (by means of, for example, adhesive bonding, pressure bonding, corona lamination, and the like) two or more separately made film articles to one another so as to form a multilayer structure; as a noun, "laminate" means a product produced by the affixing or adhering just described;

"directly adhered," as applied to film layers, means adhesion of the subject film layer to the object film layer, without a tie layer, adhesive, or other layer therebetween;

"between," as applied to film layers, means that the subject layer is disposed in the midst of two object layers, regardless of whether the subject layer is directly adhered to the object layers or whether the subject layer is separated from the object layers by one or more additional layers;

"inner layer" or "internal layer" means a layer of a film having each of its principal surfaces directly adhered to one other layer of the film;

"outer layer" means a layer of a film having less than both of its principal surfaces directly adhered to other layers of the film;

"inside layer" means the outer layer of a film in which a product is packaged that is closest, relative to the other layers of the film, to the packaged product;

"outside layer" means the outer layer of a film in which a product is packaged that is farthest, relative to the other layers of the film, from the packaged product;

"barrier layer" means a film layer capable of excluding one or more gases (e.g., $O_2$);

"abuse layer" means an outer layer and/or an inner layer that resists abrasion, puncture, and other potential causes of reduction of package integrity and/or appearance quality;

"tie layer" means an inner layer having the primary purpose of providing interlayer adhesion to adjacent layers that include otherwise non-adhering polymers;

"bulk layer" means any layer which has the purpose of increasing the abuse resistance, toughness, modulus, orientability, etc., of a multilayer film and generally comprises polymers that are inexpensive relative to other polymers in the film;

"seal layer" (or "sealing layer" or "heat seal layer" or "sealant layer") means (a) with respect to lap-type seals, one or more outer film layer(s) (in general, up to the outer 75 $\mu$m of a film can be involved in the sealing of the film to itself or another layer) involved in the sealing of the film to itself, another film layer of the same or another film, and/or another article which is not a film, or (b) with respect to fin-type seals, an inside film layer of a package, involved in the sealing of the film to itself;

as a noun, "seal" means a bond of a first region of a film surface to a second region of a film surface (or opposing film surfaces) created by heating (e.g., by means of a heated bar, hot wire, hot air, infrared radiation, ultrasonic sealing, etc.) the regions (or surfaces) to at least their respective softening points; and "cook" means to heat a food product thereby effecting a change in one or more of the physical or chemical properties thereof (e.g., color, texture, taste, and the like).

Some films, including many which are used in cook-in processes, are oriented prior to use. Orientation involves stretching a film at an elevated temperature (the orientation temperature) followed by setting the film in the stretched configuration (e.g., by cooling). When an unrestrained, non-annealed, oriented polymeric film subsequently is heated to its orientation temperature, heat shrinkage occurs and the film returns almost to its original, i.e., pre-oriented, dimensions.

An oriented film has an orientation ratio, which is the multiplication product of the extent to which the film has been expanded in several directions, usually two directions perpendicular to one another. Expansion in the longitudinal direction, sometimes referred to as the machine direction, occurs in the direction the film is formed during extrusion and/or coating. Expansion in the transverse direction means expansion across the width of the film and is perpendicular to the longitudinal direction.

DETAILED DESCRIPTION OF ILLUSTRATIVE EMBODIMENTS

Films used in the food packaging industry can be categorized by the number of layers that make up the film. Some films are made from a single polymer or blend of polymers and thus have only one layer. However, most films presently used include more than one layer, i.e., are multilayer films. In general, the layers of a multilayer film can be classified as inner or outer. Additionally, any number of tie layers can be included.

With respect to films used for cook-in processes in general, one outer layer acts as the meat-contact layer while the other acts as the outside surface of the film. The former serves as the inside layer of a package formed from the film and is in direct contact with the packaged food product. The latter provides abuse resistance and, where desired, a surface for printing.

Figure 1:
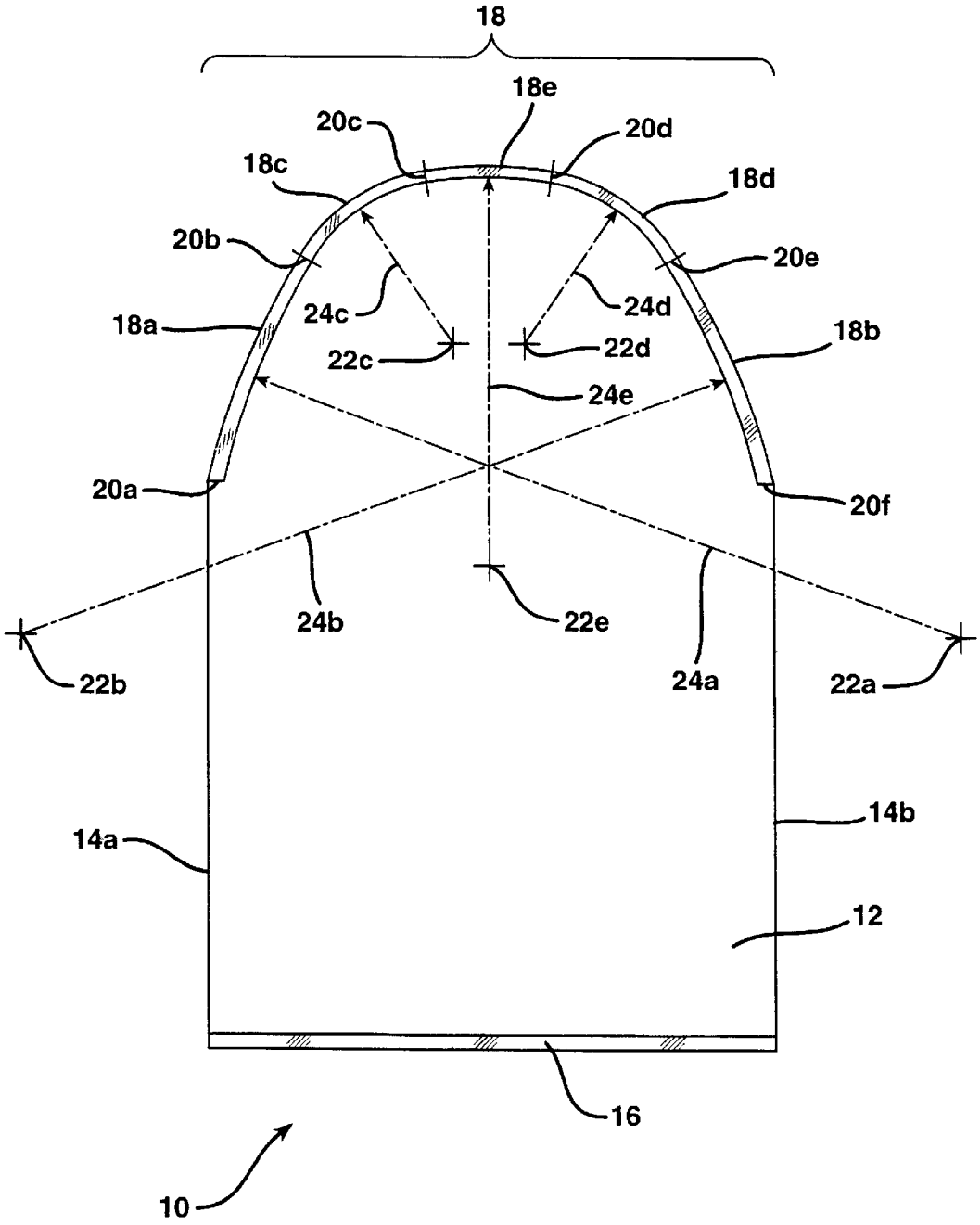
FIG. 1 is a plan view of an envelope from which can be formed one embodiment of a package according to the present invention.

In FIG. 1, envelope 10 is made from thermoplastic film material 12. Thermoplastic film material 12 can be a single- or a multilayer film as long as the layer(s) included are adequate for the end use desired for envelope 10 and the meat-contact layer of thermoplastic film material 12 contains a polymer which includes mer units derived from a $C_2$–$C_4$ α-olefin. Although thermoplastic film material 12 can be laminated, blown, or cast, it preferably is a coextruded, blown film which has been oriented, most preferably biaxially oriented. Orienting involves initially cooling an extruded film to a solid state (by, for example, cascading water or chilled air quenching) followed by reheating the film to within its orientation temperature range and stretching it. The stretching step can be accomplished in many ways such as by, for example, "blown bubble" or "tenter framing" techniques, both of which are well known to those skilled in the art. After being heated and stretched, the film is quenched rapidly while being maintained in its stretched configuration so as to set or lock in the oriented molecular configuration.

Thermoplastic film material 12 can have a longitudinal (L) direction free shrink of at least 1%, and a transverse (T) direction free shrink of at least about 1% (both measured at 85° C.). Where desirable for a particular application, thermoplastic film material 12 can have a free shrink (at 85° C.) in at least one of the L and T directions of at least 2%, at least 5%, at least 10%, at least 15%, at least 20%, at least 25%, even up to 50%. Thermoplastic film material 12 can be biaxially oriented and have a free shrink (at 85° C.) in each of the L and T directions of from about 1 to about 20%, more preferably from about 2 to about 15%, and even more preferably from about 3 to about 10%, and a total free shrink (L+T) of from about 2 to about 40%, preferably from about 2.5 to about 30%, more preferably from about 3 to about 20%, and still more preferably from about 5 to about 15%. For certain applications, orienting then heat setting or annealing thermoplastic film material 12 so as to provide a T direction free shrink (at 85° C.) of less than 10%, more preferably less than 5%, can be preferred. Heat setting can be accomplished at a temperature from about 60° to 200° C., preferably from about 70° to 150° C., and more preferably from about 80° to 90° C.

Thermoplastic film material 12 can have a shrink tension of at least about 700 kPa, preferably at least about 1050 kPa, and more preferably at least about 1400 kPa. Additionally, it can exhibit a Young's modulus (measured in accordance with ASTM D 882) of at least about 200 MPa up to about 1750 MPa. Certain preferred embodiments of thermoplastic film material can have a Young's modulus of at least about 250 MPA, preferably at least about 275 MPa, more preferably at least about 300 MPa, and even more preferably at least about 350 MPa. Other preferred embodiments of thermoplastic film material 12 can have a Young's modulus of from about 275 to about 1000 MPa, preferably from about 285 to about 825 MPa, and more preferably from about 300 to about 700 MPa.

Examples of polymers which can be used in the meat-contact layer of thermoplastic film material 12 include, but are not limited to, ethylene/α-olefin interpolymers, propylene/α-olefin interpolymers, butene/α-olefin interpolymers, ethylene/maleic anhydride interpolymers, ethylene/$C_3$–$C_{18}$ unsaturated ester interpolymers, and ethylene/$C_3$–$C_{18}$ ethylenically unsaturated acid interpolymers. Specific examples of preferred polymers include ethylene/vinyl acetate copolymer (EVA), propylene/ethylene copolymer, propylene/butene copolymer, and ethylene/α-olefin interpolymers including mer units derived from ethylene and from one or more $C_6$ to $C_{12}$ α-olefins such as 1-butene, 1-pentene, 1-hexene, 1-octene, 4-methyl-1-pentene, and the like.

Heterogeneous ethylene/α-olefin interpolymers generally have a density in the range of from about 0.86 g/cm$^3$ to about 0.94 g/cm$^3$ and can be sub-categorized as follows:

- linear low density polyethylene (LLDPE)—ethylene/α-olefin interpolymers with densities of about 0.91 to about 0.93 g/cm$^3$;
- linear medium density polyethylene (LMDPE)—ethylene/α-olefin interpolymers having densities of from about 0.93 to about 0.94 g/cm$^3$;
- very low density polyethylene (VLDPE)—ethylene/α-olefin copolymers with densities ranging from about 0.88 to about 0.91 g/cm$^3$ (Dow Chemical Co.; Midland, Mich.); and
- ultra-low density polyethylene (ULDPE)—ethylene/α-olefin copolymers with densities ranging from about 0.88 to about 0.91 g/cm$^3$ (Union Carbide Corp.; Danbury, Conn.).

In addition to the heterogeneous ethylene/α-olefin interpolymers just described, homogeneous interpolymers can be used in the meat-contact layer. These interpolymers differ structurally from heterogeneous ethylene/α-olefin interpolymers in that they exhibit a relatively even sequencing of comonomers within a chain, a mirroring of sequence distribution in all chains, and a similarity of chain lengths (i.e., a narrower molecular weight distribution). Furthermore, homogeneous interpolymers typically are prepared using single-site type catalysts (e.g., metallocenes) rather than Ziegler-Natta catalysts. Examples of commercially available homogeneous interpolymers include metallocene catalyzed EXACT™ linear ethylene/α-olefin copolymers (Exxon Chemical Co.; Baytown, Tex.); TAFMER™ linear ethylene/α-olefin copolymers (Mitsui Petrochemical Corp.); and AFFINITY™ long-chain, branched ethylene/α-olefin copolymers (Dow Chemical Co.).

The meat-contact layer of thermoplastic film material 12 preferably includes one or more interpolymers of one or more $C_2$–$C_4$ α-olefins (i.e., ethylene, propylene, and 1-butene, with ethylene and propylene being preferred) and one or more $C_3$–$C_{18}$ ethylenically unsaturated acids. Mer units derived from the $C_3$–$C_{18}$ ethylenically unsaturated acid(s) preferably make up at least 2 weight percent of the interpolymer. Useful ethylenically unsaturated acids have the general formula $CH_2{=}CRCOOH$ where R is hydrogen or a $C_1$–$C_{15}$, preferably $C_1$–$C_{10}$, more preferably $C_1$–$C_5$ alkyl, cycloalkyl, aryl, alkoxy, etc., group. The specific identity of the R group is unimportant as long as it does not interfere with the ability of the ethylenically unsaturated acid to copolymerize with the α-olefin. A preferred ethylenically unsaturated acid is (meth)acrylic acid, with acrylic acid being particularly preferred. Regardless of the identity of the α-olefin(s) and the unsaturated acid(s), the resulting interpolymer preferably has a melt index of from about 0.25 to about 50, more preferably from about 0.5 to about 10, and still more preferably from about 1 to about 5.

Because it is an inside layer, the meat-contact layer of thermoplastic film material 12 can be involved in the sealing thereof so as to form envelope 10. (Sealing is discussed more fully infra.) Accordingly, inclusion of one or more polymers having a Vicat softening poin that is/are high enough to withstand cook-in temperatures (i.e., a softening point which is greater than the temperature at which the meat product is to be cooked) but low enough to seal easily when subjected to normal heat sealing conditions is preferred. Specifically, at least about 10% (by wt.), preferably at least about 25% (by wt.), more preferably at least about 50% (by wt.), most preferably at least about 75% (by wt.) of at least one polymer having a Vicat softening point of at least about 70° C., preferably at least about 80° C., more preferably at least about 85° C., even more preferably at least about 90° C., and most preferably at least about 95° C., preferably is included in the meat-contact layer.

Of course, in addition to the polymer including mer units derived from a $C_2$–$C_4$ α-olefin, one or more other polymers can be included in the meat-contact layer of thermoplastic film structure 12. Examples of such additional polymers include those with mer units derived from (meth)acrylic acid and/or vinyl acetate. Examples of polymer blends from which the meat-contact layer can be formed include, but are not limited to, two or more ethylene/α-olefin interpolymers, an ethylene/α-olefin interpolymer and an ethylene/acrylic acid interpolymer, as well as an ethylene/acrylic acid interpolymer and an ethylene/vinyl acetate interpolymer. The ordinarily skilled artisan can readily recognize other potentially useful polymeric blends.

With respect to the α-olefin/unsaturated acid interpolymers discussed previously, for certain applications, those having a Vicat softening point (V) defined by the formula $$V \geqq 111^\circ\ \text{C.} - 2.78^\circ\ \text{C.}(m_A)$$

where $m_A$ is the percent of mer units in the interpolymer derived from an unsaturated acid, ranging from about 2 to about 25, preferably ranging from about 4 to about 15, more preferably ranging from about 6 to about 12 (with all of the foregoing ranges being inclusive of the end point values), can be beneficial. The y intercept value of the Vicat softening point in the above formula more preferably is 113° C., even more preferably 115° C., yet more preferably 117° C., and most preferably 120° C. Examples of α-olefin/unsaturated acid interpolymers which satisfy the foregoing formula include NUCREL™ ARX 84-1 and ARX 84-2 ethylene/acrylic acid copolymers (DuPont de Nemours; Wilmington, Del.), which exhibit Vicat softening points of about 97° C. and 100° C., respectively. The former includes about 6% (by wt.) mer units derived from acrylic acid, whereas the latter includes about 7% (by wt.) mer units derived from acrylic acid.

Because films with high surface energies normally adhere better to meat products, thermoplastic film material 12 preferably has a relatively high surface energy, even in the absence of a surface treatment (e.g., corona treating). Specifically, its surface energy preferably is at least 0.0325 $J/m^2$, preferably at least 0.035 $J/m^2$, more preferably at least 0.0375 $J/m^2$, even more preferably at least 0.040 $J/m^2$, and most preferably at least 0.0425 $J/m^2$.

If desired or if necessary to increase its adhesion to the enclosed meat product (not shown), the outer surface of thermoplastic film material 12 can be irradiated and/or corona treated. The former involves subjecting thermoplastic film material 12 to radiation such as corona discharge, plasma, flame, ultraviolet, X-ray, gamma ray, beta ray, and high energy electron treatment, any of which can alter the surface of the film and/or induce crosslinking between molecules of the polymers contained therein. The use of ionizing radiation for crosslinking polymers present in a film structure is disclosed in U.S. Pat. No. 4,064,296 (Bornstein et al.), the teaching of which is incorporated herein by reference. The latter technique involves bringing thermoplastic film material 12 into the proximity of an $O_2$- or $N_2$-containing gas (e.g., ambient air) which has been ionized. Various forms of plasma treatment known to those of ordinary skill in the art can be used to corona treat the outer surface of thermoplastic film material 12. Exemplary techniques are described in, for example, U.S. Pat. No. 4,120,716 (Bonet) and U.S. Pat. No. 4,879,430 (Hoffman), the disclosures of which are incorporated herein by reference.

In some instances, the polymer(s) in the meat-contact layer which provide thermoplastic film material 12 with high surface energy also can have the desired Vicat softening point (i.e., at least about 65° C., preferably at least about 70° C., most preferably at least about 75° C.). Examples of such "dual purpose" polymers include the aforementioned NUCREL™ ARX 84-1 and ARX 84-2 ethylene/acrylic acid copolymers.

For some applications, forming envelope 10 from a thermoplastic film material having a low oxygen permeance can be preferred. Such film materials, at about 23° C. and 0% relative humidity, preferably have an oxygen permeance of (in ascending order of preference) no more than about 150 $cm^3/m^2 \cdot atm \cdot 24$ hours, 125 $cm^3/m^2 \cdot atm \cdot 24$ hours, 100 $cm^3/m^2 \cdot atm \cdot 24$ hours, 75 $cm^3/m^2 \cdot atm \cdot 24$ hours, 50 $cm^3/m^2 \cdot atm \cdot 24$ hours, 30 $cm^3/m^2 \cdot atm \cdot 24$ hours, 20 $cm^3/m^2 \cdot atm \cdot 24$ hours, and 10 $cm^3/m^2 \cdot atm \cdot 24$ hours. Representative examples of polymers that can be helpful in providing a thermoplastic film material with a low oxygen permeance include ethylene/vinyl alcohol interpolymers (EVOH), polyvinylidene chloride (PVDC), polyamides, polyesters, and polyalkylene carbonates. Preferred among these are EVOH and polyamides, with the former being most preferred. In particular, EVOH having from about 32 to about 48 mole percent, more preferably from about 38 to about 44 mole percent, mer units derived from ethylene can be used to provide a film layer with excellent barrier characteristics.

As mentioned previously, thermoplastic film material 12 can be a multilayer film. In such cases, one or more other layers are coextruded or laminated to the surface of the meat-contact layer that is opposite the meat product. Where a multilayer film is used, incorporation of a layer that includes an ethylene/vinyl acetate interpolymer can be preferred.

A coextruded film that is preferred for certain applications has the general structure A/B/$C_1$/D/$C_2$ /E where A is a meat-contact layer (as described supra), B is a bulk layer, $C_1$ and $C_2$ are the same or different tie layers, D is a barrier layer (as described supra), and E is a layer derived from ethylene/vinyl acetate interpolymer optionally blended with a polymer including mer units derived from ethylene (e.g., LLDPE). Where layers A and D are compatible (i.e., adhere well in the absence of a tie layer), layers B and/or $C_1$ optionally can be omitted. Likewise, where layers D and E are compatible, layer $C_2$ optionally can be omitted.

Various combinations of layers can be used in a multilayer film to be used as thermoplastic film material 12. Although 3- and 4-layer embodiments are preferred for many applications, such films also can include more or fewer layers. In general, thermoplastic film material 12 can include from 1 to 15 layers, preferably from 1 to 10 layers, more preferably from 2 to 10 layers, and even more preferably from 3 to 7 layers.

Given below are a limited number of exemplary film structures in which alphabetical symbols are used to represent various film layers:

| | | | |
|---|---|---|---|
| A/B/C | A/B/D | A/C/B | A/C/D |
| A/D/B | A/D/C | $A/D_1/D_2$ | A/B/C/D |
| A/B/C/B | A/B/D/B | A/B/D/C | $A/B/D_1/D_2$ |
| A/C/B/D | A/C/B/C | $A/C/B_1/B_2$ | A/C/D/B |
| $A/C/D_1/D_2$ | | | |

in which

"A" represents a meat-contact layer,

"B" represents a layer including at least one of a polyolefin, polystyrene, and polyurethane, "C" represents a layer including one or more polymers that can provide a layer which has a low permeance to oxygen (preferably as described supra), and "D" represents a layer including at least one of a polyester, polyamide, polypropylene, and polyurethane.

In the foregoing structures, preferred thicknesses of the various layers are as follows:

A, B, and D (independently): from about 1 to about 100 μm, preferably from about 3 to about 50 μm, more preferably from about 4 to about 40 μm, even more preferably from about 5 to about 40 μm, still more preferably from about 7 to about 40 μm, yet more preferably from about 7 to about 35 μm, and most preferably from about 10 to about 35 μm; and C: from about 1 to about 50 μm, preferably from about 2 to about 50 μm, more preferably from about 3 to about 30 μm, even more preferably from about 4 to about 30 μm, still more preferably from about 4 to about 20 μm, yet more preferably from about 4 to about 15 μm, and most preferably from about 5 to about 15 μm.

Regardless of the structure of thermoplastic film material 12, one or more conventional packaging film additives can be included therein. Examples of additives that can be incorporated in thermoplastic film structure 12 include, but are not limited to, antiblocking agents, antifogging agents, slip agents, colorants, flavorants, antimicrobial agents, meat preservatives, and the like. (The ordinarily skilled artisan is aware of numerous examples of each of the foregoing.) Where thermoplastic film material 12 is to processed at high speeds, inclusion of one or more antiblocking agents in and/or on one or both outer layers of the film structure can be preferred. An example of a useful antiblocking agent for certain applications is corn starch.

Envelope 10 is shown with three essentially linear sides. The vertical sides, 14*a* and 14*b*, here are shown in pleated, lay-flat form, although this characteristic is merely optional. Vertical sides 14*a* and 14*b* are connected by linear seal 16. Seal 16 can be formed by providing thermoplastic film material 12 in the form of (or forming it into) a tube, applying a heated seal bar to the tube so as to form seal 16, then slitting excess film material below seal 16 (not shown). By doing so, one can form a pouch into which can be filled with a predetermined amount of meat product.

For the sake of simplicity and clarity, envelope 10 is shown as being completely sealed but without any meat product enclosed therein. In actual practice, however, contoured seal 18 normally is not formed until such a meat product is introduced.

Contoured seal 18 includes five distinct segments 18*a*–18*e*. In FIG. 1, segments 18*a*–18*e* are delineated by boundaries 20*a*–20*f* although, in actual practice, such boundaries are not present on or in envelope 10. Likewise, each of segments 18*a*–18*e* is shown with a corresponding radius of curvature 24*a*–24*e* emanating from a corresponding imaginary circle center 22*a*–22*e*. Circle centers 22*a*–22*e* and radii of curvature 24*a*–24*e* are not present in actual practice; instead, they are shown and described here to simplify and clarify the description of segments 18*a*–18*e*.

Segments 18*a*–18*e* define an imperfect arc, i.e., the arc does not define a smooth curve. Specifically, each of segments 18*a*–18*e* have a radius of curvature which differs from the radius (or radii) of curvature of the segment(s) which adjoin that particular segment. Although no two adjacent segments have identical radii of curvature, two or more non-adjacent segments can have equivalent radii of curvature. For example, in FIG. 1, segments 18*a* and 18*c* have radii of curvature 24*a* and 24*c* that are essentially identical in length to radii of curvature 24*b* and 24*d* for segments 18*b* and 18*d*, respectively.

Although envelope 10 can be of essentially any size (limited only by the size of the equipment needed to make and process thermoplastic film material 12), it preferably is formed from a blown tube of thermoplastic film material 12 that has a lay flat widths of from about 1.5 to about 50 cm, preferably from about 17.5 to about 37.5 cm, more preferably from about 20 to about 35 cm, and most preferably from about 22.5 to about 32.5 cm. Additionally, each of radii of curvature 24*a*–24*e*, corresponding to segments 18*a*–18*e* respectively, preferably is no more than about 2500 cm, more preferably no more than about 250 cm. In a preferred embodiment, at least two of radii of curvature 24*a*–24*e* are no more about 50 cm, even more preferably no more than about 25 cm. In another preferred embodiment, contoured seal 18 defines an arc of no more than about 150 cm, preferably of no more than about 100 cm, more preferably of no more than about 75 cm, even more preferably of no more than about 50 cm, still more preferably of no more than about 40 cm, and most preferably of no more than about 30 cm.

Contoured seal 18 can be formed by heat sealing the meat product-filled pouch (described supra) using a sealing jaw that has a shape corresponding to contoured seal 18. Depending on the exact shape of the distal ends of that jaw, the termini of contoured seal 18 (near imaginary boundaries 20*a* and 20*f*) can be squared-off, irregular, rounded, etc., in shape. Once contoured seal 18 has been formed, excess thermoplastic film (not shown) can be trimmed away from envelope 10.

In forming envelope 10, the sealing jaws used to create seal 16 and contoured seal 18 are maintained at an elevated temperature. The exact temperature at which such jaws are maintained depends on the identity of the polymer(s) included in the layer(s) of thermoplastic film material 12 involved in sealing. (Depending on whether a fin-type, lap-type, or butt-type seal is used which, in turn, normally is determined by the type of equipment on which the packaging process is performed, one or both of the inside and outside layers of thermoplastic film material can be involved. Preferably, both seal 16 and contoured seal 18 are fin-type seals.) In general, sealing jaws can be maintained at a temperature in the range of from about 120° to about 275° C., preferably from about 150° to about 225° C., so as to produce strong, durable seals. (As those of ordinary skill in the art are aware, higher sealing jaw temperatures can result in shorter contact times to induce sealing but also can result in more defective seals due to adhesion of the polymer to the sealing jaw.)

Although the production of envelope 10 has been described by the formation of seal 16 followed by the formation of contoured seal 18, the order in which the two seals are made can be reversed if so desired.

Although shown as essentially linear, seal 16 also can have a contoured shape, if desired. In this situation, the contour of seal 16 can be the same as or different than that of contoured seal 18. Additionally, where both seals are contoured, one seal need not define an arc which includes at least four segments, i.e., can define an arc that includes two or three segments.

As mentioned previously, the arc defined by a contoured seal of a package according to the present invention can have as few as four segments. Envelope 10 is shown with five such segments, and one of ordinary skill in the art easily can envision arcs with more than five segments. At present, those packages including a contoured seal which defines an arc having an odd number of segments are preferred with five being a particularly preferred number of segments.

Figure 2:
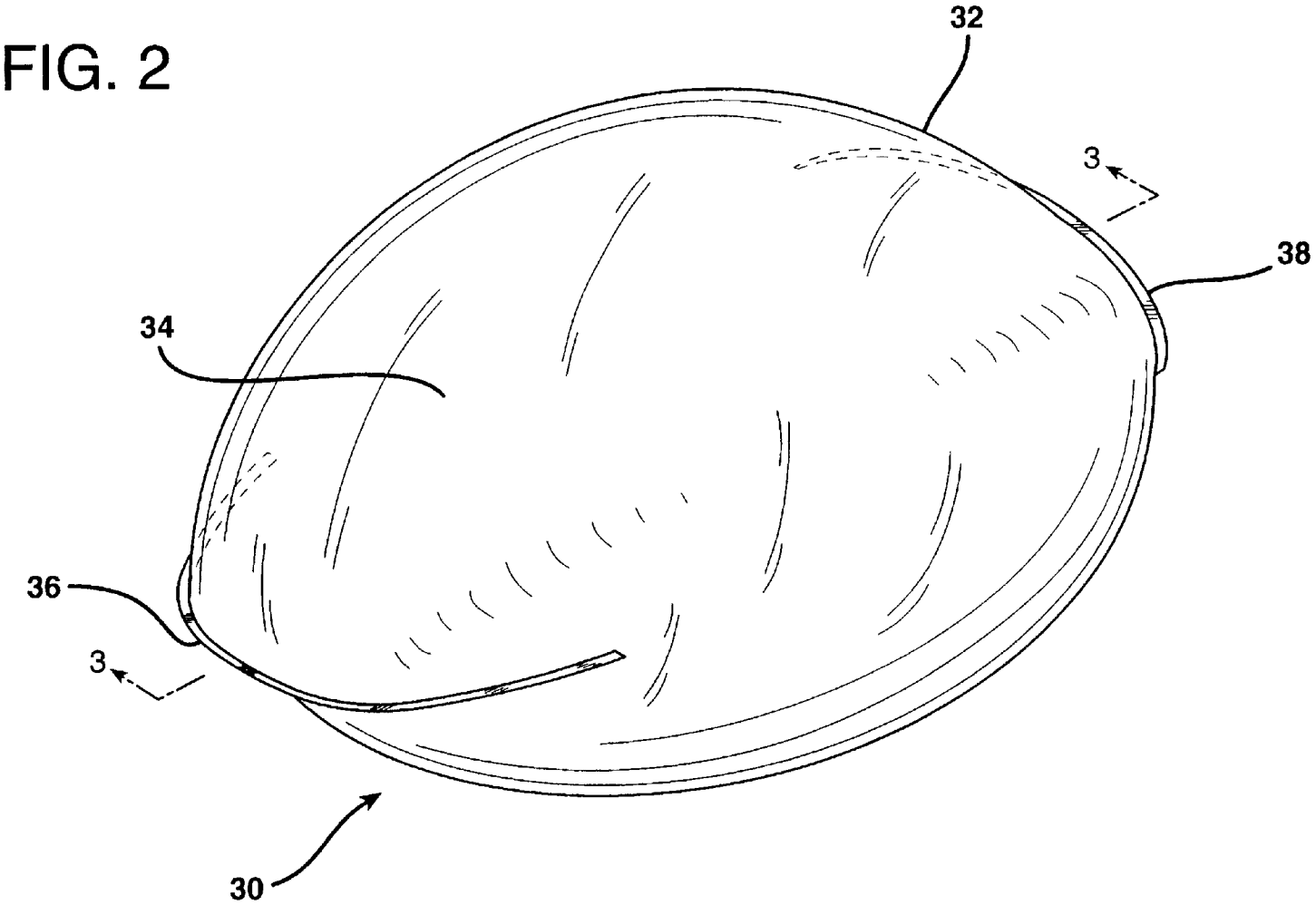
FIG. 2 is a perspective view of one embodiment of a package according to the present invention.

Turning now to FIG. 2, package 30 includes thermoplastic film material 32 completely enclosing cooked meat product 34. To form package 30, a meat product is introduced into a pouch formed from a tube of thermoplastic film material 32. (The pouch can be formed by creating cross seal 38 in the tube and then cutting away excess film material, as described supra.) Once the desired amount of meat product is added to the pouch, contoured seal 36 can be created as described previously so as to form a meat-containing envelope. As described previously, seals 36 and 38 can be formed in reverse order as just described and both of seals 36 and 38 can be contoured.

After the filled envelope is created, it is heated so as to cook the meat product. This cooking step is performed at a temperature up to about the Vicat softening point of the meat-contact layer polymer that includes mer units derived from a $C_2$–$C_4$ α-olefin polymer. The cooking step preferably is performed at a temperature of from about 50° to about 100° C., more preferably from about 60° to about 95° C., even more preferably from about 65° to about 90° C., and most preferably from about 70° to about 90° C.

During the cooking process, the meat product conforms to the shape of the envelope. As mentioned previously, this shape advantageously has the general appearance of a poultry breast. Accordingly, a preferred type of meat product includes poultry meat, particularly chicken and/or turkey breast meat.

In practice, packages of the type of package 30 typically weigh from about 1 to about 20 kg, more typically from about 2 to about 15 kg, and even more typically from about 2.5 to about 10 kg.

Figure 3:
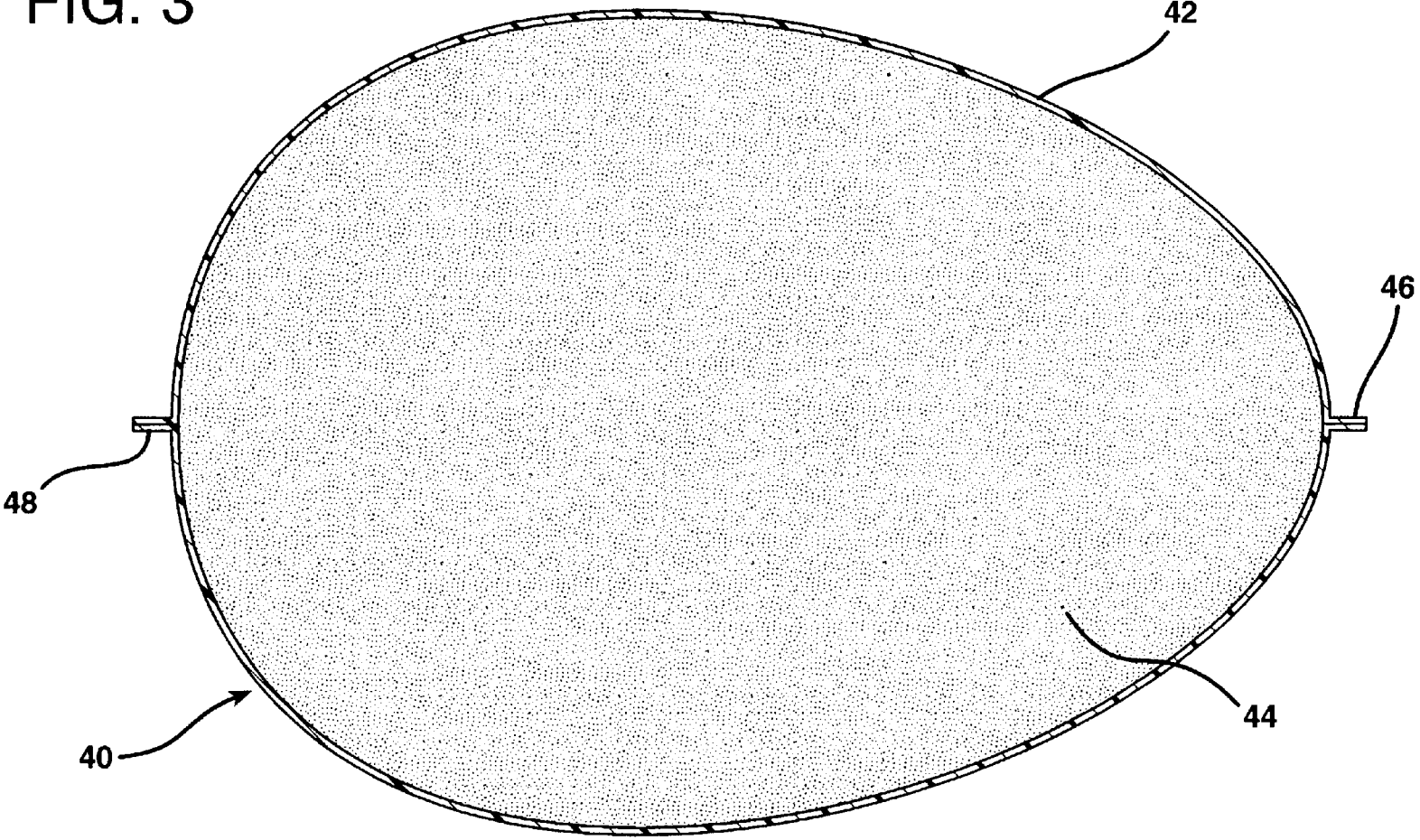
FIG. 3 is a cross sectional view taken along section line 3—3 from FIG. 2.

FIG. 3 illustrates a cross sectional view of package 30 from FIG. 2 taken along section line 3—3. In FIG. 3, package 40 includes thermoplastic film material 42 completely enclosing cooked meat product 44. Seals 46 and 48 correspond, respectively, to seals 36 and 38 from FIG. 2. Cooked meat product 44 is prepared according to the heating procedure described supra.

Various modifications and alterations that do not depart from the scope and spirit of this invention will become apparent to those skilled in the art. This invention is not to be unduly limited to the illustrative embodiments set forth herein.

We claim:

1. A method of forming a packaged, cooked food product comprising:

enclosing a food product within a package comprising a thermoplastic, heat-shrinkable film having a total free shrink at 85° C. of at least about 2% and comprising an inside layer comprising a polymer comprising mer units derived from a $C_2$–$C_4$ α-olefin, said package having at least one seal which defines an arc, said arc comprising at least four segments, each of said segments having a radius of curvature differing from the radius of curvature of any adjoining segment; and subsequently heating the packaged food product to shrink the film and to cook said food product to form a packaged, cooked food product conforming to the shape of the package.

2. The method of claim 1 wherein the food product comprises meat.

3. The method of claim 2 wherein said film further comprises a barrier layer with an oxygen permeance of no more than about 150 $cm^3/m^2$.atm.24 hours at about 23° C. and 0% relative humidity.

4. The method of claim 1 wherein said arc comprises at least five segments.

5. The method of claim 4 wherein each of said segments has a radius of curvature of no more than about 2500 cm.

6. The method of claim 5 wherein each of said segments has a radius of curvature of no more than about 250 cm.

7. The method of claim 6 wherein at least two of said segments have radii of curvature of no more than about 50 cm.

8. The method of claim 7 wherein at least two of said segments have radii of curvature of no more than about 25 cm.

9. The method of claim 8 wherein said inside layer has a surface energy of at least about 0.0325 $J/m^2$.

10. The method of claim 9 wherein said surface energy is at least about 0.0350 $J/m^2$.

11. The method of claim 9 wherein said surface energy is at least about 0.0450 $J/m^2$.

12. The method of claim 1 wherein said polymer has a Vicat softening point of at least about 70° C.

13. The method of claim 12 wherein said Vicat softening point is at least about 95° C.

14. The method of claim 1 wherein said film has a shrink tension of at least about 700 kPa at 85° C.

15. The method of claim 1 wherein said $C_2$–$C_4$ α-olefin comprises propylene.

16. The method of claim 1 wherein said polymer comprising mer units derived from a $C_2$–$C_4$ α-olefin further comprises mer units derived from one or more of at least one $C_6$–$C_{12}$ α-olefin, a $C_3$–$C_{18}$ ethylenically unsaturated ester, and a $C_3$–$C_{18}$ ethylenically unsaturated acid.

17. The method of claim 1 wherein:

the film comprises:

an inside layer comprising at least 10 weight percent of a copolymer selected from ethylene/α-olefin copolymer and propylene/α-olefin, said copolymer having at least 2 weight percent mer units derived from a $C_3$–$C_{18}$ ethylenically unsaturated acid, wherein said copolymer has a Vicat softening point "V" in ° C., of $$V > 111° C. - 2.78° C.(m_A)$$

where $m_A$ is the weight percent of mer units in said copolymer derived from said $C_3$–$C_{18}$ ethylenically unsaturated acid with $m_A$ ranging from about 2 to about 25, inclusive, and a barrier layer with an oxygen permeance of no more than about 150 $cm^3/m^2$.atm.24 hours at 23° C. and 0% relative humidity, said barrier layer comprising a polymer selected from ethylene/vinyl alcohol copolymer, ethylene/vinyl acetate copolymer, and ethylene/vinyl acetate copolymer;

said film has a surface energy of at least about 0.0325 $J/m^2$, a shrink tension of at least about 700 kPa at 85° C.; and said arc comprises at least five segments, each of said segments having a radius of curvature differing from the radius of curvature of any adjoining segment, each of said segments having a radius of curvature of no more than about 2500 cm.

18. The method of claim 17 wherein said copolymer comprises propylene/α-olefin copolymer.

19. The method of claim 1 wherein said arc comprises at least five segments, each having a radius of curvature of no more than about 2500 cm and said film has a shrink tension of at least about 700 kPa at 85° C.

20. The method of claim 1 wherein the inside layer comprises at least 10 weight percent of an interpolymer comprising mer units derived from at least one $C_2$–$C_4$ α-olefin and at least about 2 weight percent mer units derived from at least one $C_3$–$C_{18}$ unsaturated acid.

21. The method of claim 20 wherein said interpolymer has a Vicat softening point, V, of $$V > 111^\circ\ C. - 2.78^\circ\ C.(m_A)$$

where $m_A$ is the percent of mer units in said copolymer derived from said $C_3$–$C_{18}$ ethylenically unsaturated acid with $m_A$ ranging from about 2 to about 25, inclusive.

22. The method of claim 21 wherein $m_A$ ranges from about 4 to about 15, inclusive.

23. The packaged, cooked food product formed by the method of claim 1.

24. The method of claim 1 wherein the thermoplastic, heat-shrinkable film has a free shrink at 85° C. in at least one direction of at least 5%.

25. The method of claim 1 wherein the thermoplastic, heat-shrinkable film has a free shrink at 85° C. in at least one direction of at least 10%.

* * * * *